US006666781B1

(12) United States Patent
Illis

(10) Patent No.: US 6,666,781 B1
(45) Date of Patent: Dec. 23, 2003

(54) BASEBALL TRAINING DEVICE

(76) Inventor: Rudolpho Illis, Genter Str. 17, 50672 Koeln (DE)

( * ) Notice: Subject to any disclaimer, the term of this patent is extended or adjusted under 35 U.S.C. 154(b) by 0 days.

(21) Appl. No.: 09/937,109

(22) PCT Filed: Mar. 22, 2000

(86) PCT No.: PCT/DE00/00871

§ 371 (c)(1),
(2), (4) Date: Dec. 17, 2001

(87) PCT Pub. No.: WO00/56408

PCT Pub. Date: Sep. 28, 2000

(30) Foreign Application Priority Data

Mar. 23, 1999 (DE) ..... 299 05 273 U

(51) Int. Cl.[7] ..... A63B 69/00

(52) U.S. Cl. ..... 473/453; 473/417; 473/451; 273/317.6; 273/317.9; 273/407

(58) Field of Search ..... 473/417, 423, 473/426–431, 451, 453, 258, 259; 273/407, 410

(56) References Cited

U.S. PATENT DOCUMENTS 731,850 A * 6/1903 Bradbury ..... 273/355
1,341,628 A * 6/1920 Bourne ..... 273/317.9
1,439,199 A * 12/1922 Spilman ..... 273/317.3
2,985,452 A * 5/1961 Trippet ..... 473/453
3,475,026 A * 10/1969 Cooper ..... 473/430
3,953,028 A * 4/1976 Gowins ..... 473/428
4,516,771 A * 5/1985 Nau ..... 473/453
4,647,042 A * 3/1987 Bruce ..... 473/430
4,664,375 A * 5/1987 Tetreault ..... 473/429
4,819,937 A * 4/1989 Gordon ..... 473/417
4,886,267 A * 12/1989 Licciardi et al. ..... 473/417
5,002,274 A * 3/1991 Bidema ..... 473/417
5,004,234 A * 4/1991 Hollis ..... 473/417
5,029,852 A * 7/1991 Gilfillan ..... 473/417
5,595,384 A * 1/1997 Hardison, Jr. ..... 473/453

* cited by examiner

*Primary Examiner*—Paul T. Sewell
*Assistant Examiner*—Mitra Aryanpour
(74) *Attorney, Agent, or Firm*—Stites & Harbison, PLLC; David W. Nagle, Jr.

(57) ABSTRACT

A mobile practice device for practicing the swinging motion of a baseball bat includes a holding apparatus (14) and strike zone restriction apparatus (16), the strike zone restriction apparatus (16) being supported by and maintained at a distance from and underlying ground surface by the holding apparatus (14). The strike zone restriction apparatus (16) includes a vertical side wall that restricts the swing of the baseball bat (12) by a practicing batter (18).

9 Claims, 8 Drawing Sheets

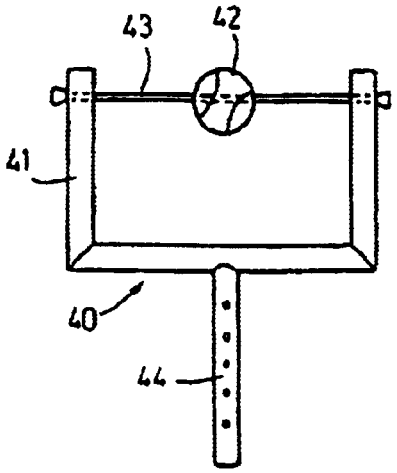
FIG.6
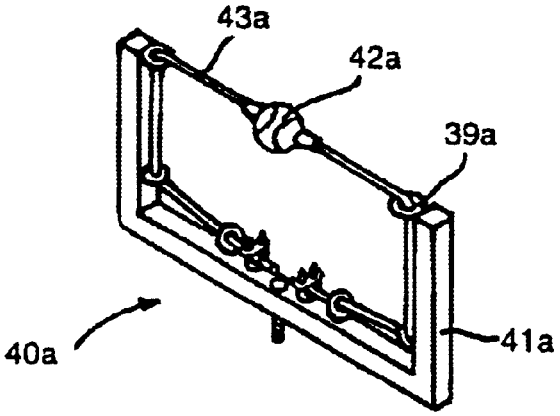
FIG. 6a
FIG.7
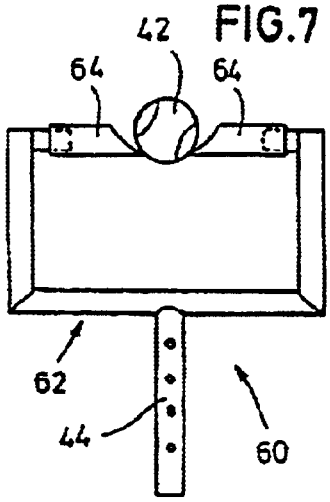

BASEBALL TRAINING DEVICE

CROSS REFERENCE TO RELATED APPLICATIONS

The present application is a national stage filing claiming priority to PCT International Application Serial No. PCT/DE00/00871 filed Mar. 22, 2000, the entire disclosure of which is incorporated herein by reference.

BACKGROUND OF THE INVENTION

The present invention is a mobile baseball practice device for practicing the batting or swinging motion of a baseball bat.

In baseball, the basic idea is for a batter to hit a baseball thrown by the pitcher of the opposing team with a baseball bat, propelling the ball in such a manner that it takes as long as possible for the opposing team to retrieve the baseball. Nowadays, the baseball is thrown at speeds of up to 160 km/h, so it is extremely important for the batter to swing the bat with as perfect a swing as possible within an extremely short reaction time and hit the ball in the central zone. This is only possible when the swinging motion is performed as an automatic reflex. For this to happen, the motion has to be practiced in such a manner as to allow the muscles to carry out the optimum swinging motion automatically.

Thus far, practice devices have been used to practice the swinging motion which utilize a pipe frame restricting the swinging motion of the baseball batter during practice. For instance, U.S. Pat. No. 5,029,852 describes a mobile pipe frame with a c-shaped, curved guide pipe extending out of the end along which the baseball bat is to be swung. The other end of the guide pipe is straight and has a horizontal surface upon which a baseball is placed and which is to be hit by the batter. U.S. Pat. No. 5,087,039 also describes a mobile pipe frame which has two pipes standing parallel to one another and pipes which are arranged one above the other. The lower pipe has a T piece upon which the baseball can be placed. The practicing batter is thus supposed to swing the baseball bat between the pipes. All existing devices share the same disadvantage, namely that the swinging motion of the baseball bat can only be restricted to an insufficient degree with respect to the distance of the end of the bat relative to the batter while at the same time allowing the swinging motion to be carried out so that only a certain predetermined type of swing can be practiced.

Furthermore, existing devices do not allow the spatial position of the baseball bat to be influenced by the practice device during the swinging motion. The position of the bat in space at the point in time when it meets the ball, however, plays a crucial role. Thus, the batter can hit the ball at the point in time when he is facing the ball frontally as well as standing sideways to the ball or even on the inner side relative to the batter. While a frontal hit and a hit on the inner side relative to the batter is considered to be a good hit, meeting the ball on the outer side relative to the batter is not practiced. If a baseball is supposed to be hit on the outer side relative to the batter, it has to be hit at an earlier point in time, whereby the baseball bat has to travel a longer distance to the ball at the same time. In end effect, the batter needs more time to guide the baseball bat correctly to the ball and the probability of meeting the ball is correspondingly lower.

It is therefore a paramount object of the present invention to provide an improved practice device to practice an optimum swinging motion of a baseball bat.

This and other objects and advantages of the present invention will become apparent upon a reading of the following description

SUMMARY OF THE INVENTION

The present invention is a mobile practice device for practicing an optimum swinging motion of a baseball bat using a strike zone restriction apparatus which includes a vertical side wall supported by a holding apparatus. As a result of the strike zone restriction apparatus, the area of motion is restricted for the head of the baseball bat, which will contact the vertical side wall as soon as the head of the bat leaves the allowed hitting zone.

Specifically, the batter stands next to the practice device. The batter needs to stand as closely as possible to the practice device, preferably approximately 50 cm to 70 cm from the vertical side wall. If the batter now makes a swinging motion from an initial position where the head of the baseball bat (viewed in the direction of the swing) is located behind the grip of the bat, the batter is forced to swing the bat in such a manner that the head of the bat is located behind the grip of the bat throughout almost the entire swing. Because the head of the bat is not allowed to leave the hitting zone above the side wall, the batter automatically swings the head of the bat between his body and the pitch trajectory in the direction of the baseball. Practicing in this manner significantly increases the probability that the baseball will regularly be hit on the inner side of the batter and not on the outer side of the batter. The swinging motion is thus generally shortened, allowing the batter relatively little time to meet the ball.

An additional advantage of the present invention is that the practicing batter has to keep his hands close to his body during the entire swinging motion, which means that the center of gravity of the baseball bat is kept comparatively close to the body, and the head of the bat can be swung at a greater speed. This allows harder and longer hits to be attained.

Moreover, compared with the aforementioned state of the art, the practice device of the present invention has the advantage that, although the zone for the swinging motion is limited, which influences how the batter holds the bat and the distance of the bat to the batter, the bat can still be moved freely within this zone. This allows the baseball to be hit in an optimum manner practicing with a pitcher or a ball-throwing device using different kinds of pitches—fastballs, slow balls, sliders, curves and screwballs. It is also possible to practice with balls which are positioned in a hitting direction in front of strike zone restriction apparatus.

In one preferred embodiment of the present invention, the mobile practice device is set up with a back wall placed predominantly at a right angle to the side wall. This restricts the back side of the zone (viewed in the swinging direction) for the motion of the bat. This also allows the baseball bat to be swung relatively close to the body, resulting in the swinging motion being relatively short and allowing the baseball bat to be swung faster. In addition, the swinging motion has diagonal components. The baseball bat is thus not swung only from the rear to the front, but rather at the same time from above to below. This ensures that the practicing batter learns to guide the head of the bat in a constant downward motion until it meets the ball. As a result, the force of gravity on the bat can be used to accelerate the swing of the bat. This allows more and better hits than if the swings were only made at a horizontal level.

In another preferred embodiment of the present invention, the mobile practice device also has a lower wall which is positioned predominantly at a right angle to the side wall. This restricts the zone for the motion of the bat on its lower side as well. This is especially advantageous when the practice device is used in conjunction with a ball holder, and the ball holder holds a baseball at a certain height in front of the practice device in the batting direction. In this case, the lower wall prevents the head of the bat hitting under the ball when practicing.

The aforementioned back and/or the lower walls can be formed with a single curved wall, the shape of the curve being adjustable to provide for an optimum swinging motion. A preferred curved wall forms an approximately 90° spherical curve, one end of which is substantially vertical and the other end of which is at an acute angle to a horizontal plane in its tangential extension.

In an alternate embodiment of the present invention, the holding device includes a height-adjustment apparatus which allows the height of the strike zone restriction apparatus to be adjusted. In particular, this allows swinging to be practiced at different levels, for instance, with a corresponding ballholding device whose height can be accordingly adjusted to hold the ball at a certain height.

As a further refinement, it is recommended that the holding device have an adjustable joint, thus allowing the strike zone restriction apparatus to be swiveled as well. This allows, for instance, the position of the curved wall, particularly the angle of its lower end relative to a horizontal plane, to be adjusted to conform to the respective swinging motion to be practiced.

In another alternate embodiment of the present invention, the holding device has a stride guide, which functions to set the side position of the batter relative to the strike zone restriction apparatus. An appropriately designed stride guide can also determine the distance of the batter to the back wall. A preferred stride guide can thus provide the practicing batter with an optimum stride-foot position. The batter can not stand in an incorrect position relative to the ball, thus ruling out improper practice.

As has been stated at several points in the foregoing, the practice device of the present invention can be provided with a ball holder which has a surface upon which a baseball can be placed, where the surface is arranged in front of the strike zone restriction apparatus (viewed in the swinging direction). The batter can place a baseball on this ball holder and swing at it. This also allows the batter to train without a pitcher, while still gaining a feel for where he will meet the ball with a certain swing. One problem here, however, is that it is comparatively time-consuming to pick up all of the balls which have been hit after the practice is finished.

For this reason, it is contemplated that some embodiments of the practice device of the present invention include a ball holder having an elastic holder element permanently linked to a baseball. The practicing batter is thus able to hit the baseball during his swing without the ball flying away, as it is held by the elastic holder. This saves the time one would otherwise have to spend picking up all the practice balls during or after the practice session, and also allows batting practice with a ball to take place in enclosed spaces. Furthermore, the elasticity of the ball holder determines the resistance against the head of the bat when it meets the ball, and can vary according to the design of the ball holder. A practice device with a ball holder can be used either alone or in combination with strike zone restriction apparatus.

In the preferred embodiments described herein, the elastic holding element of the ball holder is preferably made of a rod-like rubber element, one end of which is linked to a holding device and the other end of which is linked to the baseball. Furthermore, it is contemplated that the ball be removably linked to the holder element-for instance with a screw. Or, in another embodiment, the ball is permanently linked to the holding element to form a single unit.

As a further refinement, it is preferred that the elastic holding element is placed on an adjustable joint, allowing the position of the holding element, and thus that of the baseball, to be adjusted. An adjustable ball joint which can be continuously adjusted and set, for example, with three set screws, is particularly well suited to serve as a joint.

As a further refinement, the ball holder may also have a height-adjustment apparatus so that the height of the ball can be set. This is particularly advantageous in connection with the strike zone restriction apparatus, as this allows various swings to be practiced.

As a further refinement, the, the ball holder may also have a traverse stanchion with several points at which to connect an elastic holding element. This is also advantageous, particularly in connection with a strike zone restriction apparatus. In this design, for instance, the ball can be positioned in front of the strike zone restriction apparatus (in the direction of the swing), for example, off to the side in the direction of the batter, aligned with the side wall or offset on the side in the direction away from the batter. This allows a host of swinging techniques to be practiced.

The identified embodiments associated with the present invention apply not only to a practice device for baseball, but also to comparable sports, such as softball, without departing from the spirit and scope of the present invention

DESCRIPTION OF THE DRAWINGS

FIG. 6 is an enlarged front view of the removable ball holder of the practice device of FIG. 1;

FIG. 6*a* is an enlarged perspective view of an alternate removable ball holder for the practice device of FIG. 1;

FIG. 7 is an enlarged front view of another alternate removable ball holder for the practice device of FIG. 1;

DETAILED DESCRIPTION OF THE INVENTION

Figure 1:
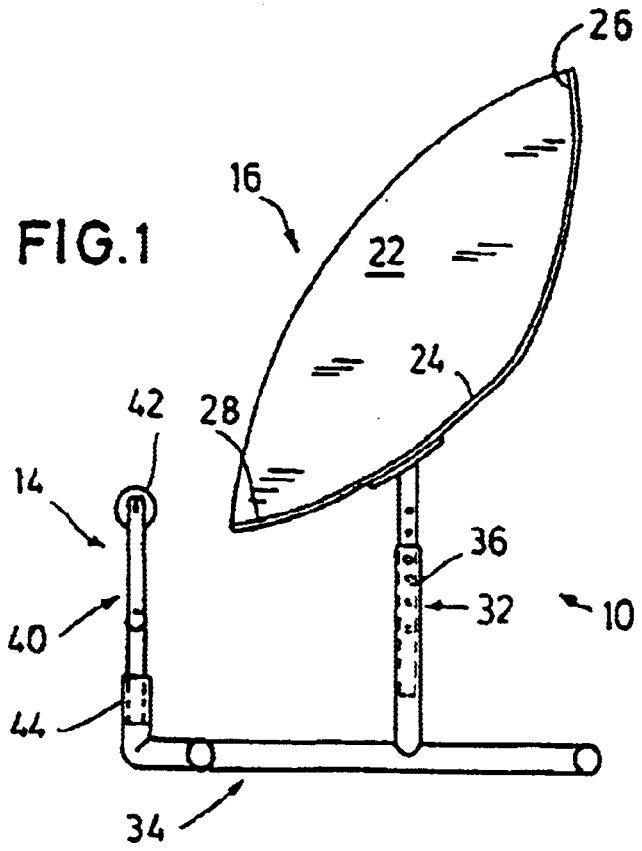
FIG. 1 is a side view of a preferred embodiment of the baseball practice device of the present invention with a removable ball holder.
Figure 2:
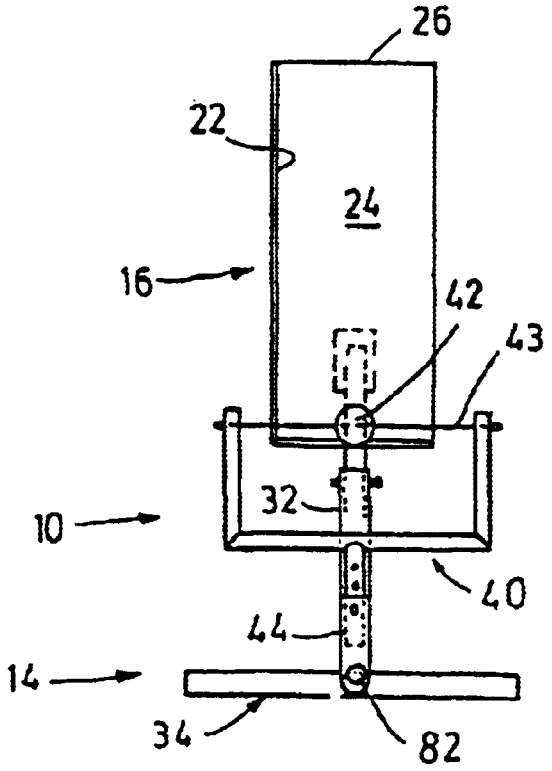
FIG. 2 is a front view of the practice device of FIG. 1.
Figure 3:
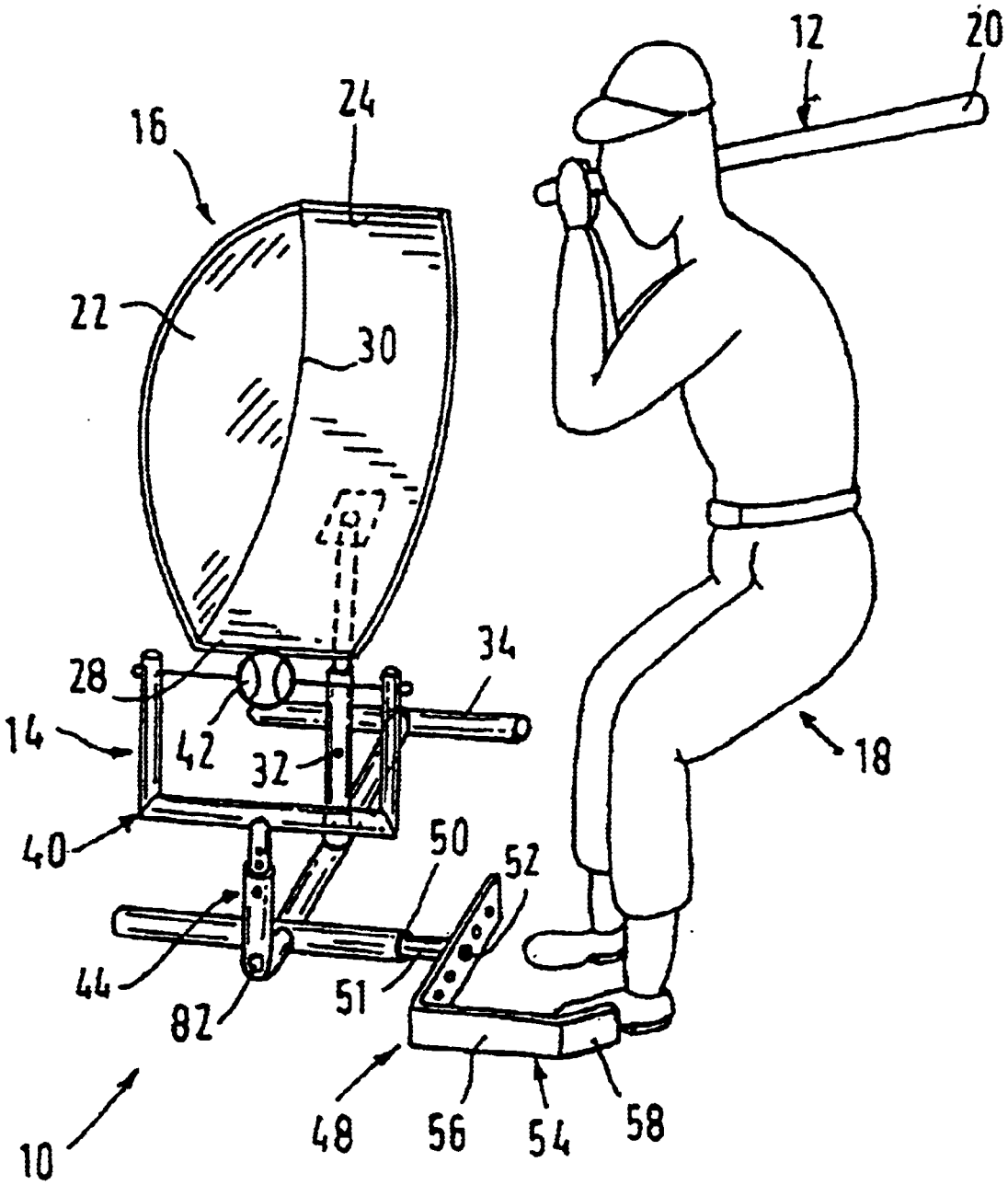
FIG. 3 is a perspective view of the practice device of FIG. 1, with a practicing batter preparing to swing his bat.
Figure 4:
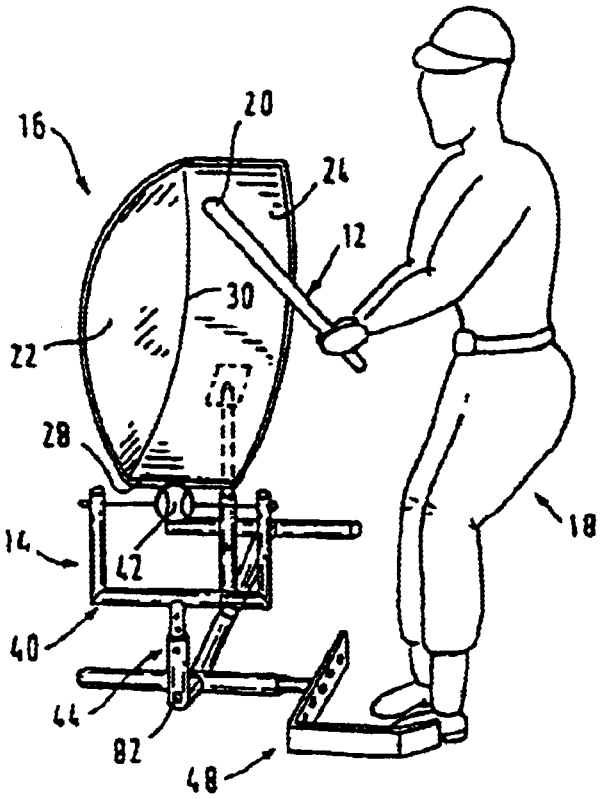
FIG. 4 is a perspective view of the practice device of FIG. 1, with the practicing batter of FIG. 3 in the middle of the swing of the bat.
Figure 5:
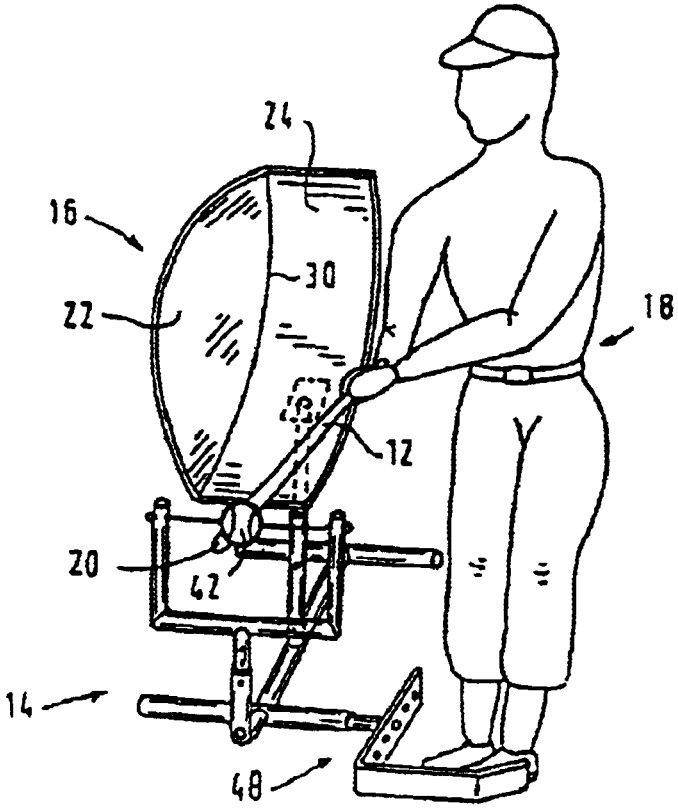
FIG. 5 is a perspective view of the practice device of FIG. 1, with the practicing batter of FIG. 3 completing the swing of the bat and hitting the ball supported by the removable ball holder.

A mobile practice device 10 for practicing the swinging motion of a baseball bat is shown in FIGS. 1 to 5. The practice device 10 generally comprises a holding apparatus 14 and strike zone restriction apparatus 16, the strike zone restriction apparatus 16 being supported by and maintained at a distance from the underlying ground surface by the holding apparatus 14. As illustrated in FIGS. 3 to 5, the strike zone restriction apparatus 16 restricts the swing of the baseball bat 12 by a practicing batter 18 by forcing the free head 20 of the baseball bat 12 to be moved within the zone constrained by the strike zone restriction apparatus 16.

The strike zone restriction apparatus 16 preferably has a substantially vertical side wall 22 and a curved wall 24 adjacent the vertical side wall 22, with the curved wall 24 forming a substantially spherical 900 curve. The upper end 26 of the curved wall 24 is oriented in a substantially vertical plane, while the front end 28 of the curved wall 24 meets in an acute angle with a substantially horizontal plane. A right-angled, curved edge line is formed where the two walls 22 and 24 meet.

The holding apparatus 14 has a vertical center holding stanchion 32 to hold the strike zone restriction apparatus 16. The center holding stanchion 32 protrudes from a double T-shaped horizontal floor frame part 34. It has a height-adjustment apparatus 36 with which the height of the strike zone restriction apparatus 16 above the ground can be adjusted. The holding apparatus 14 also includes a ball-holding device 40 which holds a baseball 42 in the front part of the practice device 10, before the front end 28 of the curved wall 24. The ball-holding device 40 has a height-adjustment device 44 with which the height of the ball 42 can be adjusted.

In addition, the holding apparatus 14 has a stride guide 48 to set the sideways distance and the longitudinal position of a practicing batter 18 relative to the strike zone restriction apparatus 16. The stride guide 48 has an adjustment device 50 to adjust the sideways distance and an additional adjustment device 52 to set the longitudinal position of a front guide piece 54 relative to the holding apparatus 14. The front guide piece 54 has a horizontal section 56 which is oriented substantially perpendicular to the longitudinal axis of the device 52 and a dog-leg section 58 bent towards the rear at approximately a 30° angle.

As best shown in FIG. 6, the preferred ball-holding device 40 has a U-shaped frame element 41 open towards the top, between the two free upper ends of which an elastic rubber band 43 is stretched. The baseball 42 is supported in the middle of and secured to the rubber elastic band 43. The baseball 42 is supported in the middle of the elastic rubber band 43 so that it is returned to the depicted stationary position after it is hit by the baseball bat 12.

Referring now to FIG. 6*a*, in an alternate construction of the ball holder 40*a* for the practice device 10 of the present invention, the free ends of two elastic rubber bands 43*a* are affixed in a central part of the lower portion of a U-shaped frame element 41*a*, which is also open towards the top. The rubber bands 43*a* lead along the respective side posts of the frame element 41*a* through retainers 39*a*, which are integral with or otherwise mounted to the frame element 41*a*, to the baseball 42*a*, which is placed between the two side posts. The elastic bands 43*a* have a longer aggregate length as compared to the band 43*a* described with respect to FIG. 6, such that the baseball 42*a* has more freedom to move when it is hit.

FIG. 7 shows an alternate removable ball holder 60 for the practice device 10 of the present invention which consists of a U-shaped frame 62 which has two horizontal, elastic hose-like holding elements 64 (preferably made of plastic) and extending from the two free upper ends of the frame 62 to hold the baseball 42.

As should be clear for the foregoing description, it is not always necessary to use a ball-holding apparatus 40, 60. When removed, a batter can use the practice device 10 of the present invention to swing at balls hrown by a pitcher or a ball-throwing machine. This makes it possible to practice in a more realistic manner.

Figure 8:
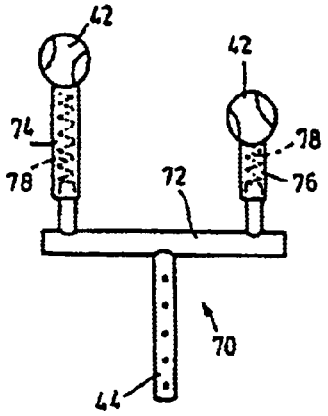
FIG. 8 is an enlarged front view of another alternate removable ball holder for the practice device of FIG. 1 with two separate ball holding elements.

FIG. 8 shows another alternate removable ball holder 70 for the practice device 10 of the present invention which has respective vertical elastic, rod-like holding elements 74, 76 (preferably of different lengths ) secured near the free ends of a horizontal cross stanchion 72. A baseball 42 is affixed to each of the holding elements 74, 76. By turning the apparatus, one can practice at different heights or practice drills for left-handers and right-handers.

Figure 9:
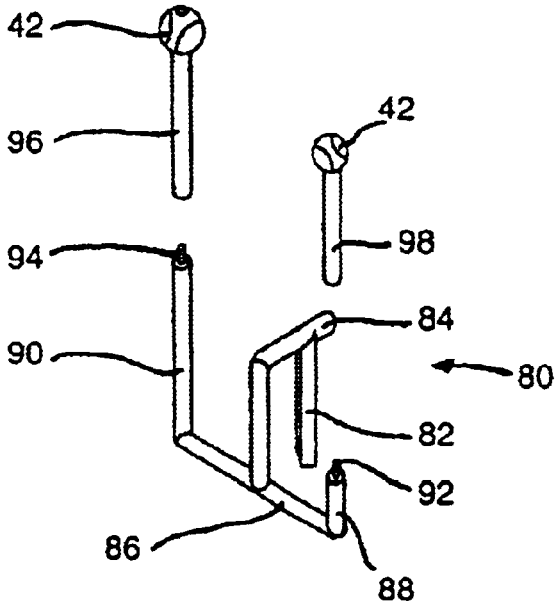
FIG. 9 is an exploded perspective view of another alternate removable ball holder for the practice device of FIG. 1, also with two separate ball holding elements.

FIG. 9 shows another alternate removable ball holder 80 for the practice device 10 of the present invention which includes a vertical capping piece 82, whose free lower end can be inserted into a carrier apparatus (not shown) defined by the holding apparatus 14 of the practice device 10. The capping piece 82 is linked on its top side to a horizontal section of an L-shaped carrier element 84. A U-shaped frame 86 which is open towards the top is secured to the carrier element 84,. The side posts 88, 90 of the U-shaped frame 86 each have a different vertical height and are fitted with screws 92, 94 which extend in an upward direction. Elastic, rod-shaped holding elements 96, 98, each of which is adapted to hold a baseball 42 at its free end, can then be fastened onto the screws 92, 94. A baseball 42 can either be linked to one of the elastic holding elements 96, 98, for example, via a screw linkage, or,be integral with the holding element.

Figure 10:
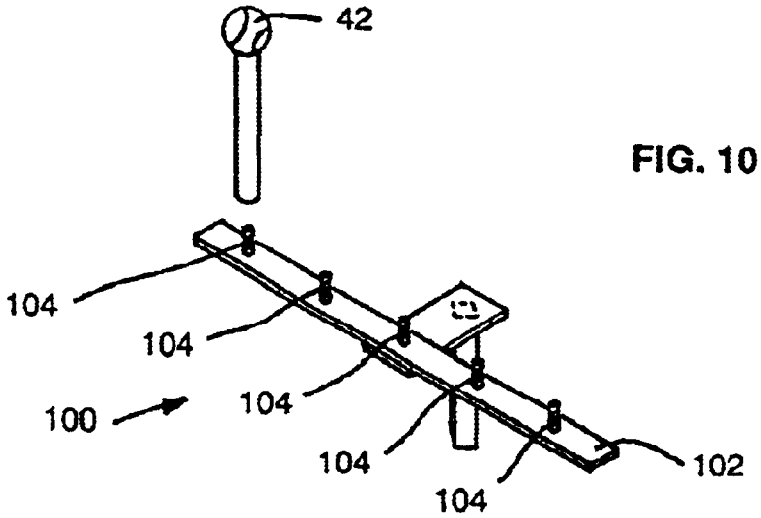
FIG. 10 is a an exploded perspective view of an alternate removable ball holder for the practice device of FIG. 1, with a plurality of connection locations for a ball holding element.

FIG. 10 shows another alternate removable ball holder 100 for the practice device of the present invention in which there are a variety of connection elements 104 arranged along the length of a horizontal holder 102. In the embodiment shown, these connection elements 104 are formed as screws extending upward and adapted to receive an elastic holding element , onto which a baseball 42 can be secured.

Returning to the preferred practice device illustrated in FIGS. 1–5, the adjustment devices 36, 44 and 50 each preferably consist of an outer pipe provided with a cross hole and an inner pipe which has several cross holes. The inner pipe is preferably set with respect to the outer pipe by a pin that is passed through the cross hole of the outer pipe and one of the cross holes of the inner pipe, although similar fastening mechanisms could also be used without departing from the spirit and scope of the present invention. The adjustment device 52 for adjusting the stride guide 48 preferably consists of a threaded opening through the end of the connecting pipe 51. A screw is inserted through one of the several holes defined along the metal guide piece 54 and into the threaded opening of the connecting pipe 51 to secure the metal guide piece 54 with respect to the connecting pipe 51.

All parts of the practice device 10 are preferably made of metal, with the exception of the elastic band 43, 43*a*, the holding frame 40, 40*a* and the elastic holding elements 64, 74, 96, 98 and 106 of the ball-holding apparatus 60, 70, 80 and 100 depicted in FIGS. 6 to 9. Of course, various components of the practice device 10 could also be made of plastic or other materials without departing from the spirit and scope of the present invention The elastic holding elements 64, 74, 96, 98 and 106 are preferably in the form as rods made of rubber, whose ends are formed in such a manner as to allow them to be screwed together with a holder or the baseball 42.

It is also noteworthy that the practice device 10 can be dismantled from the height-adjustment apparatus and arranged in a small package for transport purposes.

Figure 11:
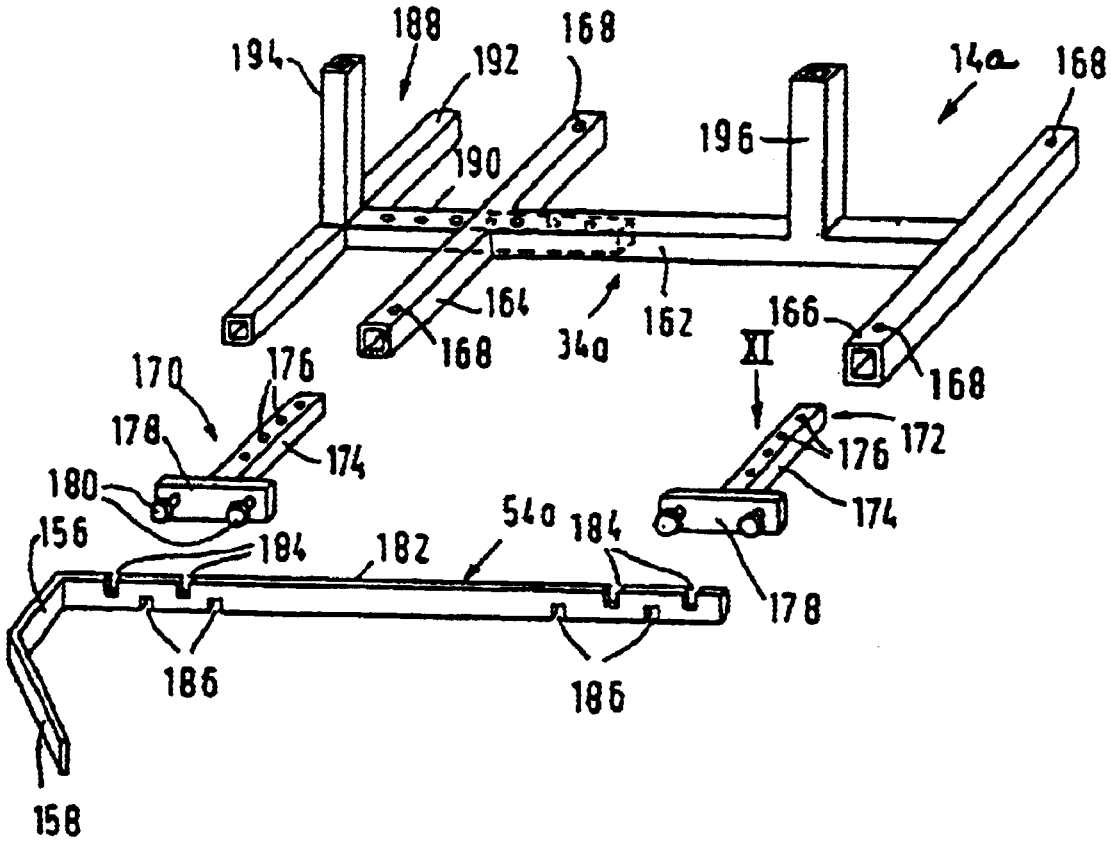
FIG. 11 is an exploded perspective view of an alternate holding apparatus for the practice device of the present invention.

FIG. 11 is an exploded perspective view of an alternate holding apparatus for the practice device 10 of the present invention. The holding apparatus 14*a* is comprised of a plurality of rectangular tubes which are welded or similarly joined together to form a floor frame part 34*a* having a double-T shape. The floor frame part 34*a* has a longitudinal piece 162 and two cross pieces 164, 166. Each of the cross pieces 164, 166 extends from the opposite ends of the longitudinal piece 162. There is a hole 168 defined through each of the ends of the cross pieces 164, 166 through which a bolt is preferably inserted to secure a side frame part 170, 172 to the floor frame part 34*a*. Specifically, each of the side frame parts 170, 172 includes a shaft 174, a portion of which is inserted into the respective cross piece 164, 166. There are a series of holes 176 defined through each shaft 174, a selected one of which can be aligned with the hole 168 associated with the respective cross piece 164, 166 such that a pin (not shown) can be used to secure a side frame part 170, 172 to a respective cross piece 164, 166.

Figure 12:
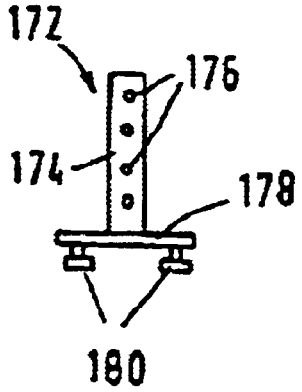
FIG. 12 is a plan view of a side frame part of the alternate holding apparatus of FIG. 11.

Referring now to FIG. 12, each side frame part 170, 172 includes a plate 178 with two bolts 180 extending from the surface of the plate 178, each of said bolts 180 having an enlarged head. The guide piece 54*a* is secured to the side frame parts 170, 172. Specifically, the guide piece 54*a* comprises a longitudinal portion 182, a horizontal section 156 which branches off from the longitudinal portion 182 at an angle and a dog-leg section 158 bent towards the rear at an acute angle. Several notches 184 are defined through the longitudinal portion 182 along the top surface, and several notches 186 are defined through the longitudinal portion 182 along the lower surface. The notches 184 and 186 are arranged in pairs, whereby the notches of each pair have the same distance between them as the bolts 180 of the side frame parts 170, 172. The notches 184 are for receiving and retaining the respective bolts 180 when the guide piece 54*a* is secured to the left side of the holding apparatus 14*a*, and the notches 186 are for receiving and retaining the bolts 180 when the guide piece 54*a* is secured to the right side of the holding apparatus 14*a*. This allows the same guide piece 54*a* to be used for right-handers and left-handers. The notches 184, 186 can also be distributed across the entire length of the guide piece 54*a*.

Referring again to FIG. 11, a frame part 188 is provided at one end of the holding apparatus 14*a* to extend the longitudinal piece 162 which the ball-holding device can be affixed to. The frame part 188 has a longitudinal piece 190 which is telescopically inserted into the end of the longitudinal piece 162 and is secured by a bolt or similar fastener (not shown). A cross piece 192 is secured to and oriented substantially perpendicular to the longitudinal piece 190 in a horizontal plane. In addition, a substantially vertical stanchion 194 is secured at the intersection of the longitudinal piece 190 and cross piece 192, upon which a ball-holding apparatus (not shown), whose height can be adjusted, is secured.

Lastly, with respect to FIG. 11, a center stanchion 196 is secured to and extends from the longitudinal piece 162. This stanchion 196 is not located in the middle of the piece 162; rather, it is placed nearer to the back cross piece 166. The center stanchion 196 serves as a holder for the strike zone restriction apparatus.

In an alternate embodiment of the holding apparatus which is not illustrated, not only one center stanchion, but rather three stanchions are provided for, arranged at different places along the back cross piece 166. This allows the strike zone restriction apparatus to also be placed sideways to the longitudinal axis of the holding apparatus 14*a*.

Figure 13:
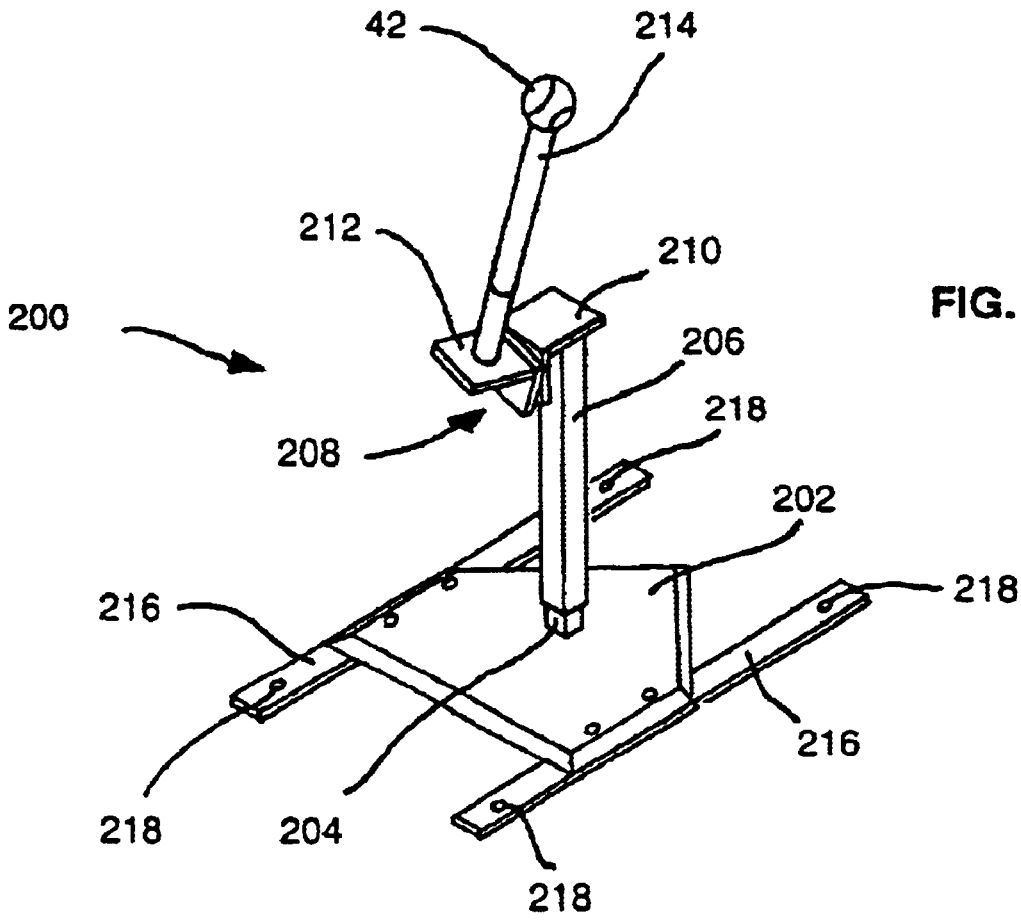
FIG. 13 is a perspective view of an alternate embodiment of a ball holder and underlying holding apparatus.

FIG. 13 shows an alternate embodiment of a ball holder and underlying holding apparatus. The ball-holding apparatus 200 includes a base plate 202, with a center stanchion 204 secured to and extending from the base plate 202. A vertical carrying tube 206 is secured to the center stanchion 204. At the upper end of the vertical carrying tube 206, there is a joint connection 208 consisting of two angled elements 210, 212 each of which is attached and can be traversed and adjusted together. While the first angled element 210 is firmly connected to the vertical carrying tube 206, the second angled element 212 supports an elastic holding element 214 for a baseball 42. This allows the elastic holding element 214 and the baseball 42 to be swiveled at one level. The base plate 202 itself is mounted on rail elements 216 which are provided with openings 218 so that it can be secured to the ground. Furthermore, as shown in FIG. 13, the base plate 202 is formed in the shape of a home plateused in baseball so that the batter standing at the ball-holding apparatus 200 receives a competitive feeling when practicing.

Figure 14:
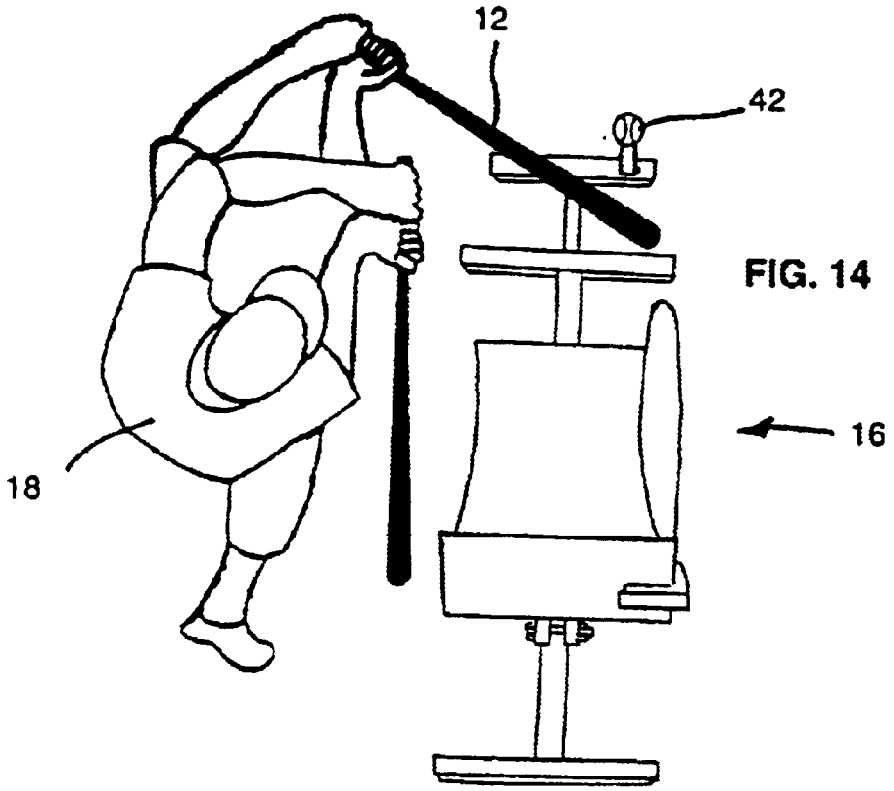
FIG. 14 is a top view of a practice device in accordance with the present invention, illustrating the swinging of the bat.
Figure 15:
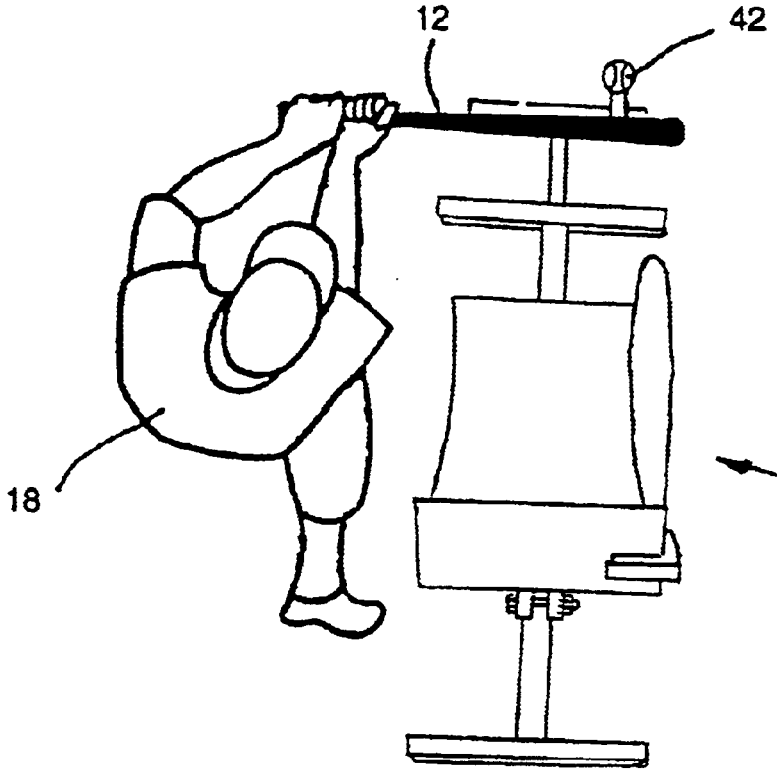
FIG. 15 is a top view of a practice device of FIG. 14, illustrating the contact of the bat with the baseball.

Finally, in FIGS. 14 and 15, a batter is depicted from above during a swinging motion, or at the point in time shortly before the head of the bat meets the baseball. It is clear that the head of the bat is located for the most part between the body of the batter and the pitch trajectory of the baseball during the entire swing. While the batter depicted in FIG. 14 will meet the ball on the inner side, the batter depicted in FIG. 15 will meet the ball frontally.

It will be obvious to those skilled in the art that other modifications may be made to the invention as described herein without departing from the spirit and scope of the present invention.

What is claimed is:

1. A baseball practice device (10) for practicing the swinging motion of a bat (12), comprising:

a holding frame (34) placed on an underlying ground surface;

holding apparatus (14) supported on said holding frame (34); and a strike zone restriction apparatus (16) supported on said holding flame (34) and having at least one vertical side wall (22) for restricting the swinging motion of the bat (12), a back wall set approximately at a right angle to said side wall (22), and a lower wall set approximately at a right angle to said side wall (22), wherein said back wall and said lower wall form a continuous curved wall (24), said continuous curved wall (24) having a spherical 90° curvature, a first end (26) of said curved wall (24) being oriented in a substantially vertical plane and a second end (28) of said curved wall (24) being oriented at an acute angle to a substantially horizontal plane.

2. A baseball practice device (10) as recited in claim 1, wherein said holding apparatus (14) has an associated height adjustment apparatus (36) for independent adjustment of the height of said strike zone restriction apparatus (16) relative to said holding apparatus (14).

3. A baseball practice device (10) as recited in claim 1, wherein said holding apparatus (14) has an adjustable joint for adjustment of the incline of said strike zone restriction apparatus (16) relative to the holding apparatus (14).

4. A baseball practice device (10) as recited in claim 1, and further comprising a removable ball holder secured to and supported by said holding apparatus (14), said removable ball holder having at least one holding element for receiving a baseball (42) and maintaining said baseball (42) in front of said strike zone restriction apparatus (16).

5. A baseball practice device (10) as recited in claim 4, wherein said baseball (42) is permanently attached to the holding element of said removable ball holder (40).

6. A baseball practice device (10) as recited in claim 4, wherein said holding element is a substantially rubber rod, a first distal end of the rod being secured to said holding apparatus (14) and a second distal end of the rod being secured to said baseball (42).

7. A baseball practice device (10) as recited in claim 4, wherein said ball holder (40) is capable of independent height adjustment relative to the holding apparatus (14).

8. A baseball practice device (10) as recited in claim 4, wherein said ball holder (40) includes a transverse stanchion having several connection points for said holding element.

9. A baseball practice device (10) as recited in claim 1, wherein said holding apparatus (14) includes a stride guide (48) to establish the position of a batter (18) relative to said strike zone restriction apparatus (16).

* * * * *